US005697772A

United States Patent [19]

Kawamura et al.

[11] Patent Number: 5,697,772

[45] Date of Patent: Dec. 16, 1997

[54] SCREW ROTOR AND METHOD OF GENERATING TOOTH PROFILE THEREFOR

[75] Inventors: Takeshi Kawamura; Kiyoshi Yanagisawa, both of Kanagawa-ken; Shigeyoshi Nagata, Tokyo, all of Japan

[73] Assignee: Ebara Corporation, Tokyo, Japan

[21] Appl. No.: 626,959

[22] Filed: Apr. 3, 1996

[30] Foreign Application Priority Data

Apr. 5, 1995 [JP] Japan ..... 7-080465

[51] Int. Cl.[6] ..... F01C 1/16

[52] U.S. Cl. ..... 418/201.3; 418/1; 418/150; 29/888.023

[58] Field of Search ..... 418/1, 150, 201.1, 418/201.3; 29/888.02, 888.023

[56] References Cited

U.S. PATENT DOCUMENTS

| | | | |
|---|---|---|---|
| 2,511,878 | 6/1950 | Rathman | 418/201.1 |
| 2,931,308 | 4/1960 | Luthi | 418/150 |
| 4,543,048 | 9/1985 | Densch | 418/201.3 |

FOREIGN PATENT DOCUMENTS

| | | |
|---|---|---|
| 325 597 | 12/1957 | France . |
| 112 104 | 12/1917 | Germany . |
| 57-46083 | 3/1982 | Japan . |
| 62-291486 | 12/1987 | Japan . |

*Primary Examiner*—Charles G. Freay

*Attorney, Agent, or Firm*—Armstrong, Westerman, Hattori, McLeand & Naughton

[57] ABSTRACT

The transverse tooth profile of a screw rotor which meshes with a companion screw rotor is defined by a tooth root circular arc, an outer circumferential circular arc, and two curves interconnecting the tooth root circular arc and the outer circumferential circular arc. One of the curves is defined by a trochoid curve generated by a point on an outer circumferential surface of the companion screw rotor. Alternatively, the curve may comprise two curve segments, and one of the two curve segments comprising a tooth tip arc which is defined as an arc having a radius of curvature equal to or smaller than the difference between a radius of curvature of the outer circumferential circular arc and a radius of a pitch circle of the tooth profile, and the other of the two curve segments comprising a curve connected to the tooth root circular arc and determined by a curve generated by the tooth tip arc of the companion screw rotor. The other curve is defined by determining a curve which defines an imaginary rack and thereafter producing a tooth profile curve generated by the imaginary rack.

11 Claims, 15 Drawing Sheets

SCREW ROTOR AND METHOD OF GENERATING TOOTH PROFILE THEREFOR

BACKGROUND OF THE INVENTION

1. Field of the Invention

The present invention relates to a screw rotor, a method of generating a transverse or normal-to-axis tooth profile for such a screw rotor, and a screw machine which has a pair of such screw rotors.

2. Description of the Related Art

One conventional screw vacuum pump is disclosed in Japanese laid-open utility model publication No. 63-14884. The disclosed screw vacuum pump has a pair of screw rotors meshing with each other. Each of the screw rotors has a square tooth profile which includes a chamfer designed to prevent the intermeshing screw rotors from interfering with each other when the screw rotors are rotated to pump a fluid. Since the fluid leaks through the chamfers of the screw rotors, however, the screw vacuum pump has a low efficiency.

The tooth profile has an outer circumferential width which is necessarily equal to half the screw pitch, resulting in no freedom in designing the outer circumferential width. With the disclosed screw vacuum pump, therefore, it is not possible to design an optimum outer circumferential width that is governed by the displacement, the compression ratio, and the gap around the screw rotors of the screw vacuum pump. As a consequence, the screw vacuum pump requires an unduly large surface seal around the screw rotors, thus reducing the volume of grooves of the screw rotors.

If the grooves of the screw rotors were made deeper in order to increase the flow rate with the square tooth profile, then the amount of interference between the screw rotors would be increased. To prevent the screw rotors from interfering with each other to an increased degree, it would be necessary to increase clearances between the intermeshing screw teeth. The increased spaces between the intermeshing screw teeth would then lower the efficiency of the screw vacuum pump.

There has been known a Quimby tooth profile for use as an interference-free birotor tooth profile. However, the Quimby tooth profile fails to provide a completely continuous seal line, thus causing a fluid leakage from a discharge port to a suction port of a screw machine such as a screw vacuum pump. Accordingly, the Quimby tooth profile is not suitable for use as a tooth profile for screw rotors in machines for handling gases.

One known screw tooth profile which does not cause any interference between screw rotors and provides a complete seal line is disclosed in Japanese patent publication No. 64-8193. The disclosed screw tooth profile is designed for use in liquid pumps. Because the screw tooth profile forms a liquid seal by liquid handled by the pump to minimize any liquid leakage, a complete seal line is created by the intermeshing screw rotors thereby to produce a high pump head with one pitch.

Screw machines such as screw vacuum pumps in which screw rotors rotate with a very small clearance kept therebetween have their performance largely affected by any fluid leakage along the outer circumferential surfaces of the screw rotors. If an arcuate or cycloid tooth profile is used as a continuous-single-point-contact tooth profile when adopting the screw tooth profile disclosed in Japanese patent publication No. 64-8193, then since the outer circumferential width is automatically determined by the radii of tooth tip and root circular arcs, no designing freedom is available for the tooth profile as in the square tooth profile disclosed in Japanese laid-open utility model publication No. 63-14884.

SUMMARY OF THE INVENTION

It is therefore an object of the present invention to provide a screw rotor which will produce a minimum of fluid leakage when incorporated in a screw machine, a method of generating a transverse or normal-to-axis tooth profile of such a screw rotor, and a screw machine which incorporates such a screw rotor therein.

According to one aspect of the present invention, there is provided a method of generating a transverse tooth profile of a screw rotor, comprising the steps of: defining a transverse tooth profile of a screw rotor meshing with a companion screw rotor, with a tooth root circular arc, an outer circumferential circular arc, and two curves interconnecting the tooth root circular arc and the outer circumferential circular arc; defining one of the two curves by a trochoid curve generated by a point on an outer circumferential surface of the companion screw rotor; and defining the other of the two curves by determining a curve which defines an imaginary rack and producing a tooth profile curve generated by the imaginary rack.

According to another aspect of the present invention, there is also provided a method of generating a transverse tooth profile of a screw rotor, comprising the steps of: defining a transverse tooth profile of a screw rotor meshing with a companion screw rotor, with a tooth root circular arc, an outer circumferential circular arc, and two curves connected to the tooth root circular arc; defining one of the two curves by determining a curve which defines an imaginary rack and producing a tooth profile curve generated by the imaginary rack; and the other of the two curves comprising two curve segments, one of the two curve segments comprising a tooth tip arc which is defined as an arc having a radius of curvature equal to or smaller than the difference between a radius of curvature of the outer circumferential circular arc and a radius of a pitch circle of the tooth profile and is connected to said outer circumferential circular arc, and the other of the two curve segments comprising a curve connected to the tooth root circular arc and determined by a curve generated by a tooth tip arc of the companion screw rotor.

In each of the above methods, the curve which defines the imaginary rack should preferably comprise a sine curve or a combination of two involute curves.

According to still another aspect of the present invention, there is further provided a screw rotor for meshing with a companion screw rotor, having a transverse tooth profile, the transverse tooth profile comprising: a tooth root circular arc; an outer circumferential circular arc; and two curves interconnecting the tooth root circular arc and the outer circumferential circular arc; wherein one of the curves is defined by a trochoid curve generated by a point on an outer circumferential surface of the companion screw rotor, and the other of the curves is generated by an imaginary rack which is defined by a predetermined curve.

According to still another aspect of the present invention, there is also provided a screw rotor for meshing with a companion screw rotor, having a transverse tooth profile, the transverse tooth profile comprising: a tooth root circular arc; an outer circumferential circular arc; and two curves connected to the tooth root circular arc; wherein one of the curves is generated by an imaginary rack which is defined by a predetermined curve, and the other of the curves comprises two curve segments, one of the two curve segments comprising a tooth tip arc which is defined as an arc having a radius of curvature equal to or smaller than the difference between a radius of the outer circumferential circular arc and a radius of a pitch circle of the tooth profile and is connected to said outer circumferential circular arc, and the other of the two curve segments comprising a curve connected to the tooth root circular arc and determined by a curve generated by a tooth tip arc of the companion screw rotor.

In each of the above screw rotors, the predetermined curve which defines the imaginary rack should preferably comprise a sine curve or a combination of two involute curves.

According to still another aspect of the present invention, there is further provided a screw machine having a pair of screw rotors held in mesh with each other and out of contact with each other and rotatable in synchronism with each other for drawing and discharging a fluid, each of the screw rotors having a transverse tooth profile, the transverse tooth profile comprising: a tooth root circular arc; an outer circumferential circular arc; and two curves interconnecting the tooth root circular arc and the outer circumferential circular arc; wherein one of the curves is defined by a trochoid curve generated by a point on an outer circumferential surface of the companion screw rotor, and the other of the curves is generated by an imaginary rack which is defined by a predetermined curve.

According to still another aspect of the present invention, there is also provided a screw machine having a pair of screw rotors held in mesh with each other and out of contact with each other and rotatable in synchronism with each other for drawing and discharging a fluid, each of the screw rotors having a transverse tooth profile, the transverse tooth profile comprising: a tooth root circular arc; an outer circumferential circular arc; and two curves connected to the tooth root circular arc; wherein one of the curves is generated by an imaginary rack which is defined by a predetermined curve, and the other of the curves comprises two curve segments, one of the two curve segments comprising a tooth tip arc which is defined as an arc having a radius of curvature equal to or smaller than the difference between a radius of the outer circumferential circular arc and a radius of a pitch circle of the tooth profile and is connected to the outer circumferential circular arc, and the other of the two curve segments comprising a curve connected to the tooth root circular arc and determined by a curve generated by a tooth tip arc of the companion screw rotor.

In each of the above screw machines, the predetermined curve which defines the imaginary rack should preferably comprise a sine curve or a combination of two involute curves. Each of the screw rotors should not be limited to a single screw thread, but may have two or more screw threads. The fluid drawn and discharged by the screw machine is preferably gas, but should not be limited to gas.

With the above arrangement, one of the curves which interconnect the tooth root circular arc and the outer circumferential circular arc comprises a trochoid curve generated by a point on an outer circumferential surface of the companion screw rotor, or a curve generated by a tooth tip arc of the companion screw rotor, and the other of the curves is generated by an imaginary rack which is defined by a predetermined curve. The tooth profiles of the screw rotors of the above configuration are theoretically kept out of interference with each other. Therefore, it is not necessary to chamfer the tooth profiles of the screw rotors or unduly increase the clearance between the tooth profiles of the screw rotors to avoid any interference therebetween. Consequently, the screw rotors provide a complete seal line therebetween for minimizing any fluid leakage between the screw rotors in the screw machine. Inasmuch as the tooth profile according to the present invention is free of any interference at all between the screw rotors, the depth of the screw rotor grooves can be increased to thus increase flow rate of screw machine with the screw rotors.

If the screw rotor is single-threaded and has groove of increased depth, then it tends to be out of dynamic equilibrium upon rotation because the center of gravity of the tooth profile is not aligned with the center of the screw rotor, and hence is not suitable for high-speed rotation. If the screw rotor has multiple thread such as double-thread, however, since the center of gravity of the tooth profile is aligned with the center of the multiple-threaded screw rotor, the screw rotor is kept in dynamic equilibrium upon rotation, and can be rotated at high speed.

In the case where the tooth profile of the screw rotor has a tooth tip arc, the tooth tip arc is held in surface-to-surface contact with the companion screw rotor, thus providing a surface seal for minimizing a fluid leakage.

If the screw rotors are multiple-threaded such as double-threaded, then they fail to provide a complete seal line. However, any leakage path which allows a fluid leakage therethrough between the screw rotors can be minimized by optimizing the tooth profile and the screw lead. Therefore, any fluid leakage caused by the multiple-threaded screw rotors may be suppressed to the point where it will not substantially adversely affect the performance of the screw machine.

In addition, parameters of the screw rotor such as an outer circumferential width can freely be determined without limitations posed by the screw pitch and the radii of the tooth tip and root arcs. The screw rotor can thus be designed for a more ideal configuration. The width of the surface seal on the outer circumferential surface of the screw rotor may be optimized for a reduced fluid leakage.

Since the tooth profile of the screw rotor can be generated by continuous curves from the tooth tip to the tooth root, the tooth profile is free from any locations where it might otherwise severely damage a cutter for machining the screw rotor. Accordingly, the screw rotor according to the present invention can be manufactured efficiently.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
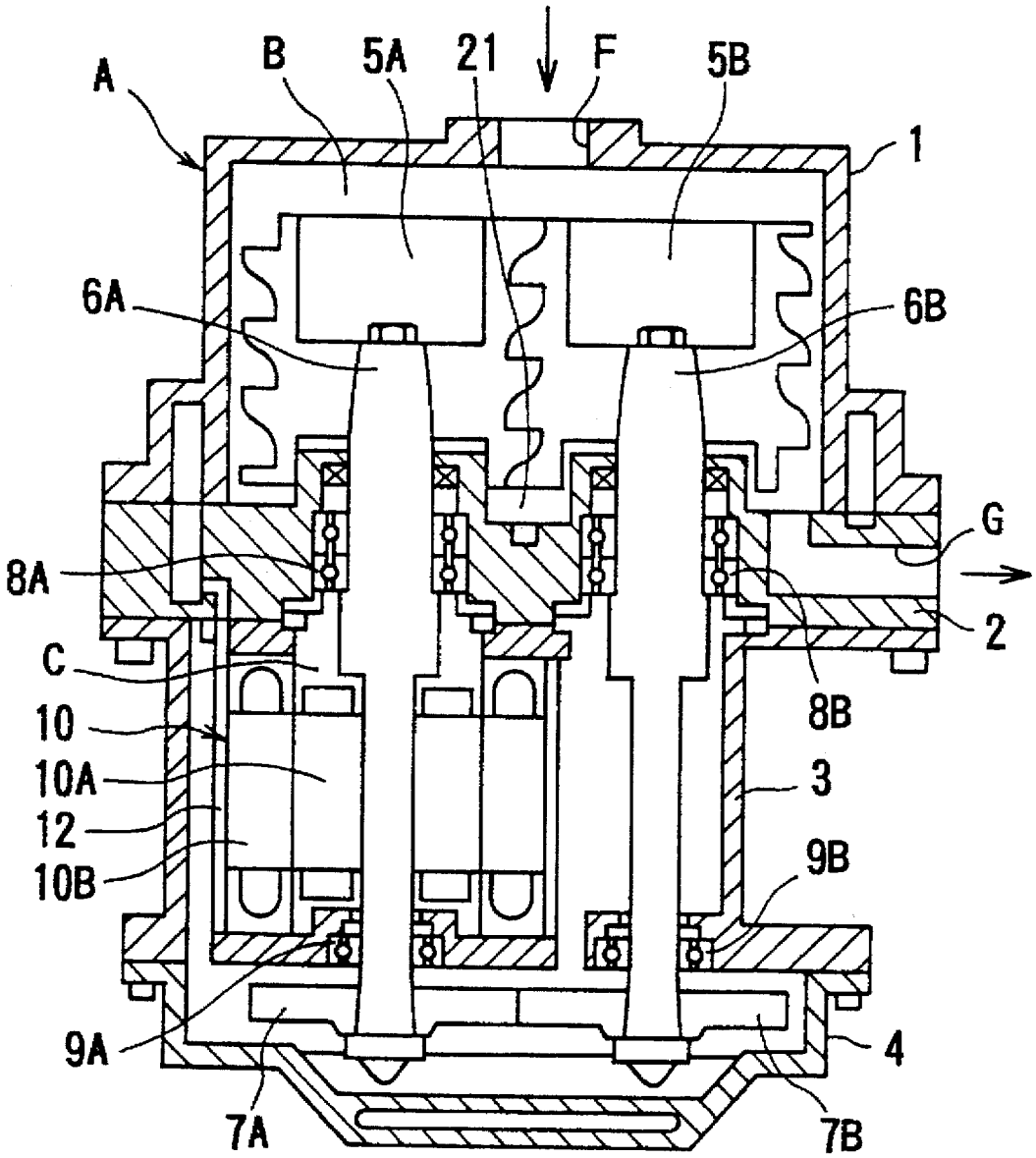
FIG. 1 is a cross-sectional view of a pair of screw rotors according to an embodiment of the present invention, incorporated in a screw vacuum pump as a screw machine.
Figure 2:
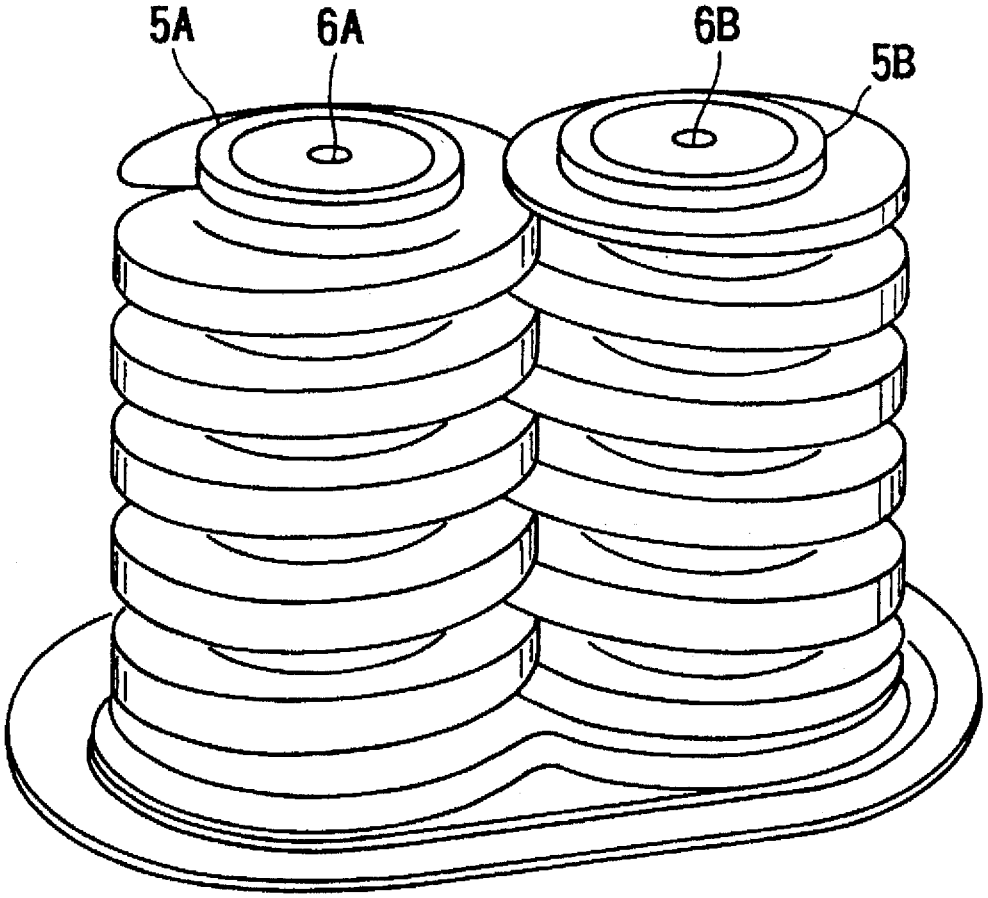
FIG. 2 is a perspective view of the screw rotors shown in FIG. 1.
Figure 3:
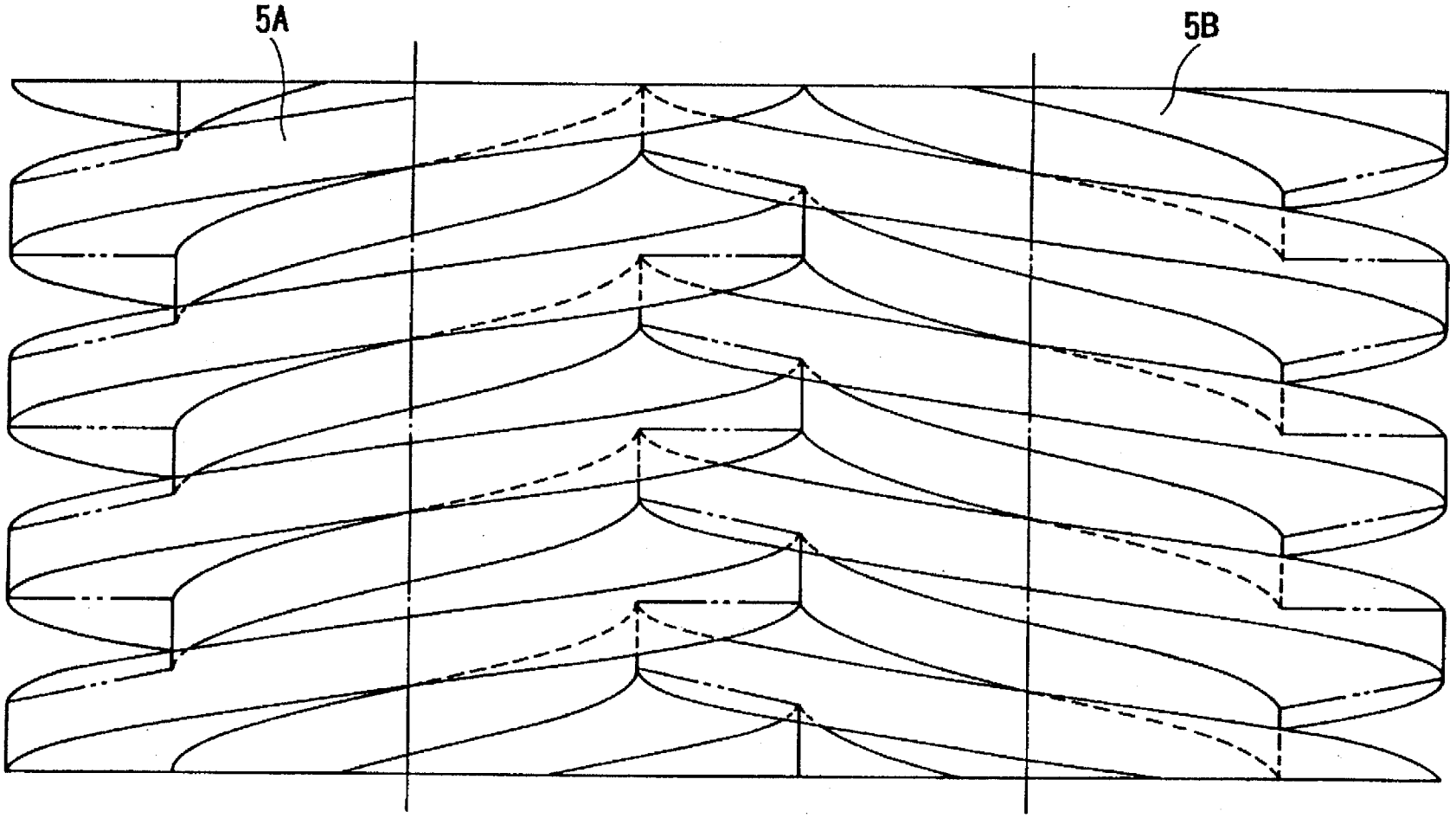
FIG. 3 is a fragmentary front elevational view of the screw rotors shown in FIG. 1.

As shown in FIG. 1, a screw vacuum pump as a screw machine which incorporates screw rotors according to an embodiment of the present invention has a pump housing A comprising an upper rotor casing 1, a central casing 2 joined to a lower end of the upper rotor casing 1, and a lower casing 3 joined to a lower end of the central casing 2. The upper rotor casing 1 has a pump chamber B defined therein which houses a pair of screw rotors 5A, 5B which mesh with each other in a substantially 8-shaped cross sectional configuration. The screw rotors 5A, 5B are fixedly mounted on respective upper ends of parallel rotatable shafts 6A, 6B that are rotatably supported by upper bearings 8A, 8B and lower bearings 9A, 9B in the pump housing A. The screw rotors 5A, 5B have screw teeth helical coiled in opposite directions and held in mesh with each other and out of contact with each other, as shown in FIGS. 2 and 3.

The lower casing 3 has a motor rotor chamber C defined therein which accommodates a motor rotor. The lower casing 3 houses therein a motor stator casing 12 disposed around the motor rotor chamber C. A motor 10 has a motor rotor 10A mounted on the rotatable shaft 6A and disposed in the motor rotor chamber C, and a motor stator 10B supported in the motor stator casing 12 around the motor rotor 10A. The rotatable shafts 6A, 6B have respective lower ends supporting timing gears 7A, 7B, respectively, which are held in mesh with each other. When the motor 10 is energized, the rotatable shafts 6A, 6B rotate in opposite directions through the timing gears 7A, 7B for rotating the screw rotors 5A, 5B in synchronously with each other.

The rotor casing 1 has a suction port F defined in an upper end wall thereof and held in communication with the pump chamber B. The screw rotors 5A, 5B have a lower discharge end remote from their upper end facing the suction port F and spaced from an upper end of the central casing 2. A discharge space 21 is defined between the lower discharge end of the screw rotors 5A, 5B and the upper end of the central casing 2. The discharge space 21 communicates with a discharge port G defined in and opening laterally of the central casing 2. The lower discharge ends of the screw rotors 5A, 5B is exposed in its entirety to the discharge space 21.

Figure 4:
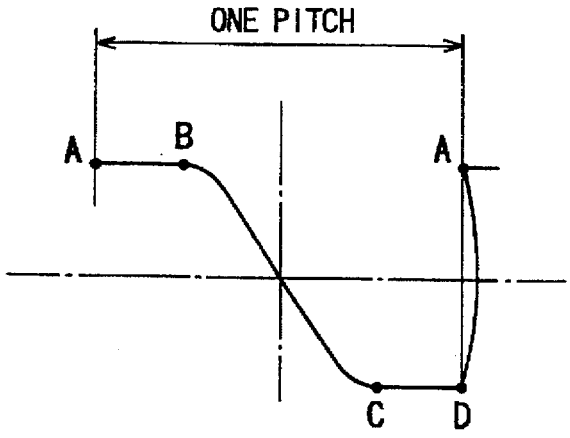
FIG. 4 is an enlarged fragmentary axial cross-sectional view of a screw tooth of the screw rotors.
Figure 5:
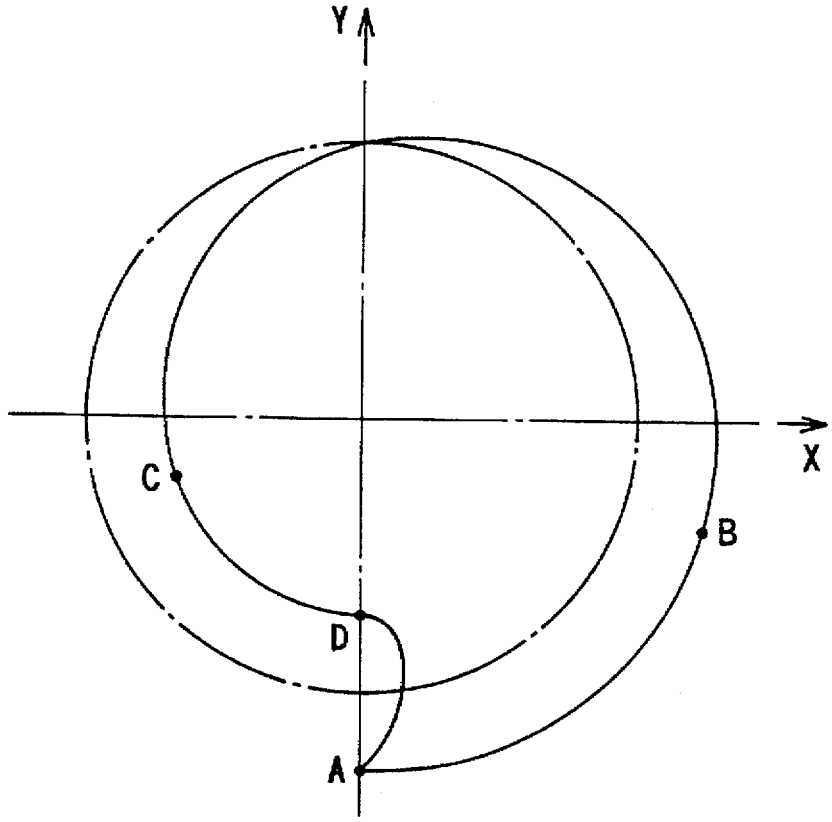
FIG. 5 is an enlarged fragmentary transverse cross-sectional view of the screw tooth shown in FIG. 4.
Figure 6:
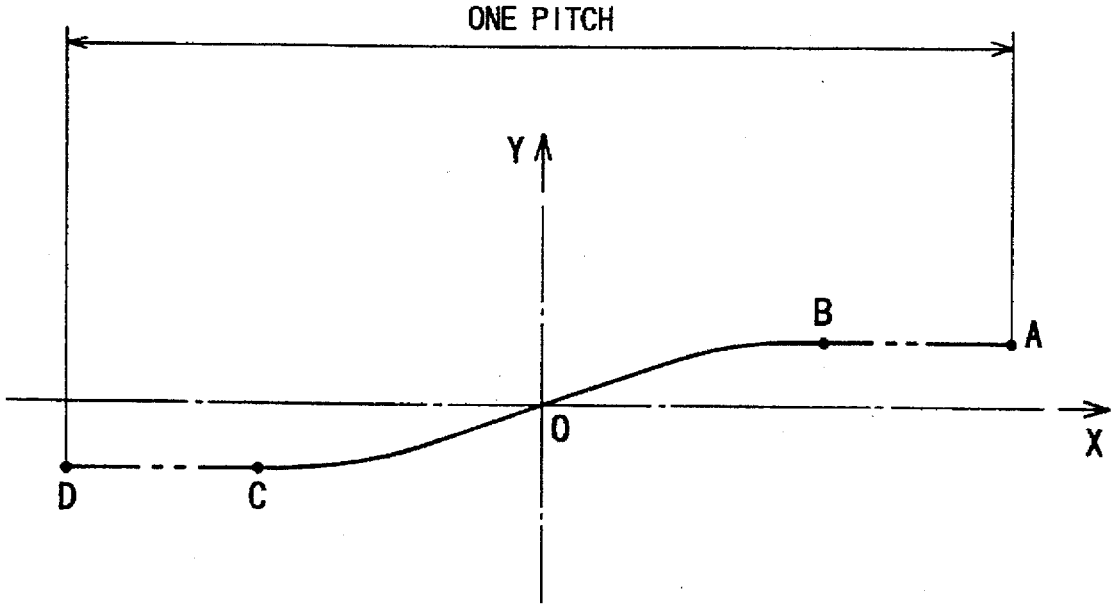
FIG. 6 is a diagram of an imaginary rack for generating the screw tooth shown in FIG. 5.

The screw rotors 5A, 5B have respective screw teeth each having an axial tooth profile as shown in FIG. 4 and a transverse or normal-to-axis tooth profile as shown in FIG. 5. As shown in FIG. 5, the transverse tooth profile comprises an outer circumferential circular arc AB extending around the center of the screw rotor, a tooth root circular arc CD extending around the center of the screw rotor, a curve BC interconnecting the outer circumferential circular arc AB and the tooth root circular arc CD, and a curve DA interconnecting the outer circumferential circular arc AB and the tooth root circular arc CD in substantially diametrically opposite relation to the curve BC. In the transverse tooth profile, the curve DA is defined by a trochoid curve generated by a point A on the outer circumferential surface of the companion screw rotor, and the curve BC is defined by a process of producing an imaginary rack defined by a sine curve as shown in FIG. 6 and a process of producing a tooth profile curve generated by the imaginary rack.

Figure 7:
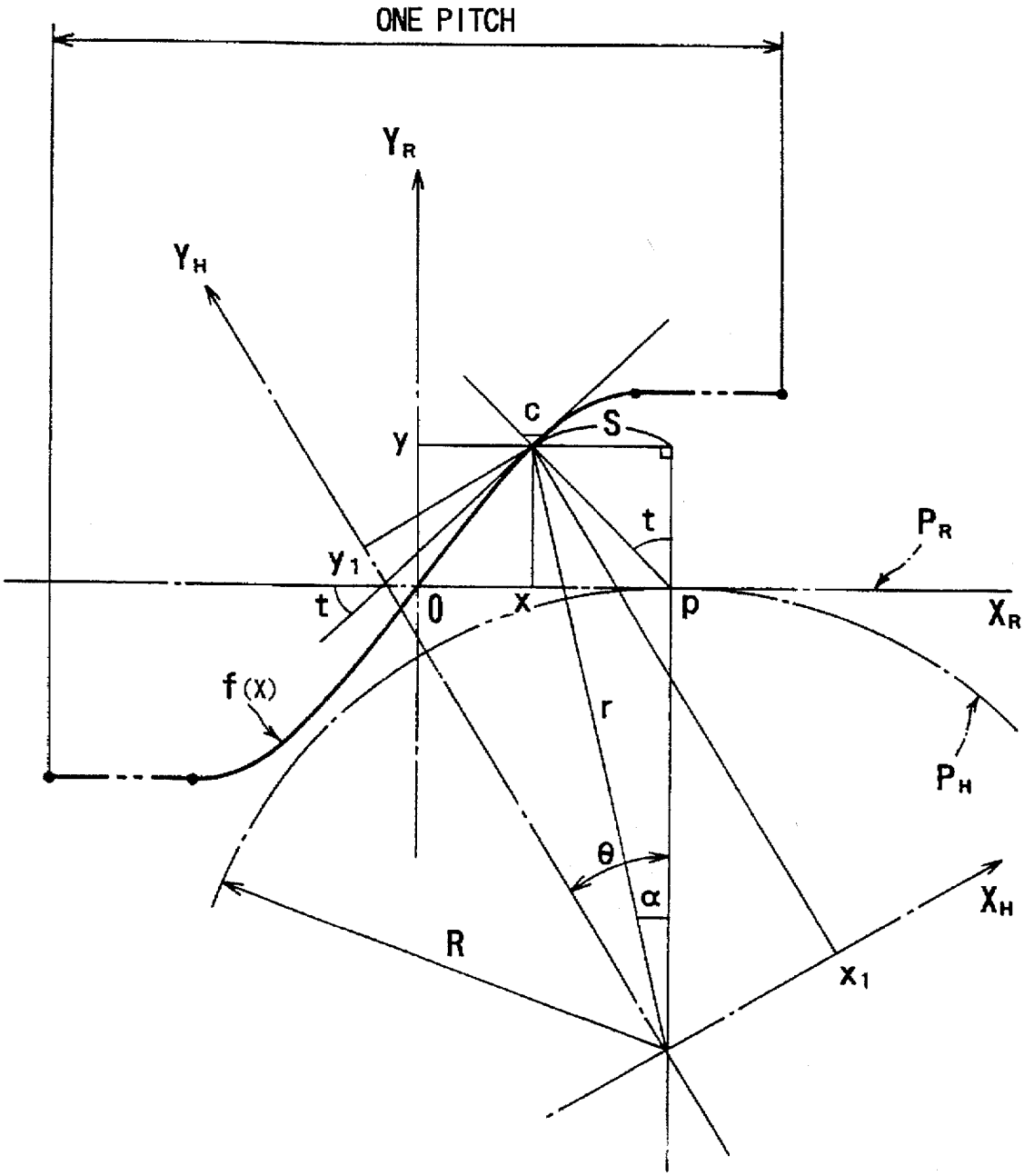
FIG. 7 is a diagram showing the relationship between the imaginary rack and a tooth profile.

The relationship between the curve BC and the imaginary rack will be described below with reference to FIG. 7. The imaginary rack has a pitch line $P_R$. FIG. 7 shows a pitch circle $P_H$ of the tooth profile and a curve f(x) defining the imaginary rack, as a pitch circle $P_H$ has rotated in contact with a pitch line $P_R$ of the imaginary rack from an origin 0 to a point P through an angle θ.

If it is assumed that the imaginary rack and the tooth profile contact with each other at a point c having coordinates (x, y) in a rack coordinate system $X_R$–$Y_R$, the imaginary rack has its shape represented by y=f(x), with its derivative expressed by f' (x), and the pitch circle $P_H$ has a radius R, then an angle α, the angle θ, and a distance r from the center of the pitch circle $P_H$ to the point c are expressed by the following equations:

$$\alpha=\tan^{-1}[\{y\cdot f'(x)\}/(R+y)] \quad (1)$$

$$\theta=\{x+y\cdot f'(x)\}/R \quad (2)$$

$$r=\{(R+y)^2+(y\cdot f'(x))^2\}^{1/2} \quad (3)$$

The point c has coordinates ($x_1$, $y_1$) in a tooth profile coordinate system $X_H$–$Y_H$ and is expressed as follows:

$$x_1=r\cdot\sin(\theta-\alpha) \quad (4)$$

$$y_1=r\cdot\cos(\theta-\alpha) \quad (5)$$

When the equations (1)–(3) are substituted in the equations (4), (5) thereby to convert the coordinates (x, y) of the point c in the rack coordinate system $X_R$–$Y_R$ into the coordinates ($X_1$, $Y_1$) in the tooth profile coordinate system $X_H$–$Y_H$, the shape of the curve BC of the teeth profile (see FIG. 5) is determined.

The curve DA which interconnects the outer circumferential circular arc AB and the tooth root circular arc CD on the tooth profile of the screw rotor 5A is represented by a curve generated by the point A on the outer circumferential circular arc of the companion tooth profile 5B, and the other curve BC is represented by a curve generated by the imaginary rack. Theoretically, therefore, the tooth profiles of the screw rotors 5A, 5B do not interfere with each other. It is not necessary to chamfer the tooth profiles of the screw rotors 5A, 5B or unduly increase the clearance between the tooth profiles of the screw rotors 5A, 5B to avoid any interference therebetween. Consequently, the screw rotors 5A, 5B provide a complete seal line therebetween for minimizing any fluid leakage between the screw rotors 5A, 5B in the screw vacuum pump.

Figure 8:
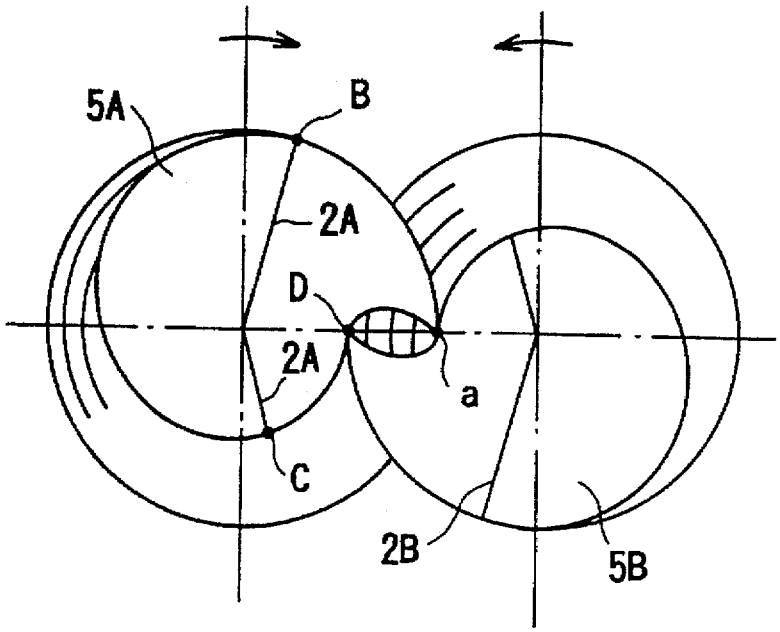
FIG. 8 is a view of a phase of intermeshing engagement between the screw rotors shown in FIG. 1.
Figure 9:
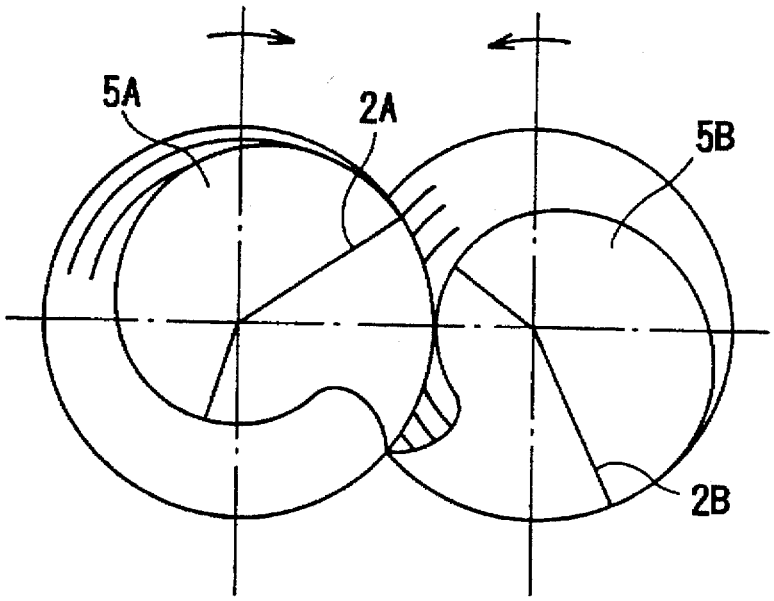
FIG. 9 is a view of another phase, next to the phase shown in FIG. 8, of intermeshing engagement between the screw rotors.
Figure 10:
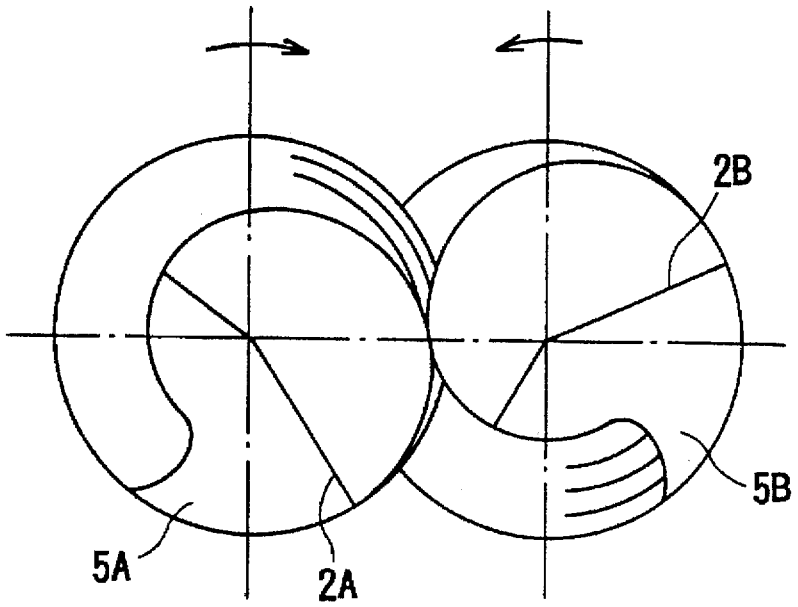
FIG. 10 is a view of still another phase, next to the phase shown in FIG. 9, of intermeshing engagement between the screw rotors.
Figure 11:
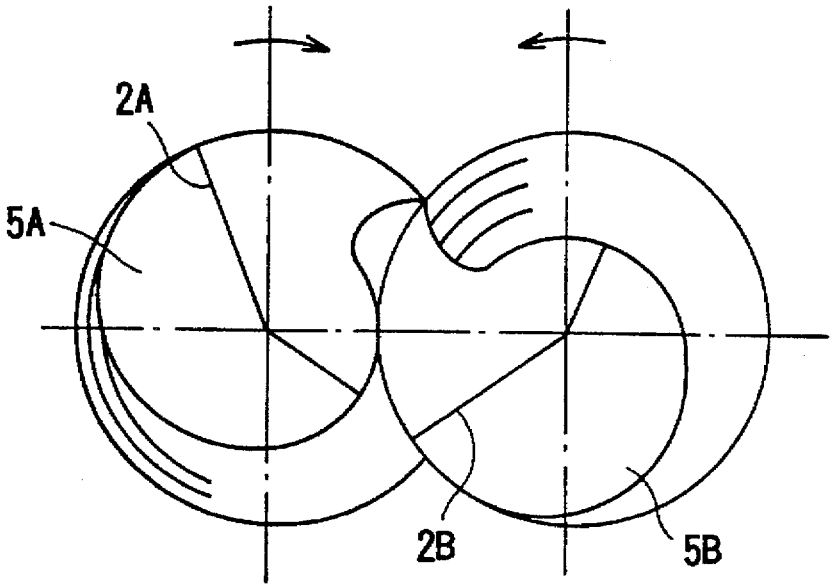
FIG. 11 is a view of yet still another phase, next to the phase shown in FIG. 10, of intermeshing engagement between the screw rotors.

FIGS. 8 through 11 show successive phases of intermeshing engagement between the screw rotors 5A, 5B shown in FIG. 1, illustrating the manner in which the tooth profile of the screw rotors 5A, 5B prevents them from interfering with each other while they are rotating in mesh with each other. In FIG. 8, the screw rotors 5A, 5B are shown as being in the position shown in FIG. 3, and lines 2A, 2B interconnecting the center of each screw rotor and the points B, C. In FIGS. 9 through 11, the screw rotors 5A, 5B are shown as being rotated in successive phases from the position shown in FIG. 3. It can be seen from FIGS. 8 through 11 that the screw rotors 5A, 5B are prevented from interfering with each other while they are rotating in mesh with each other.

Figure 12:
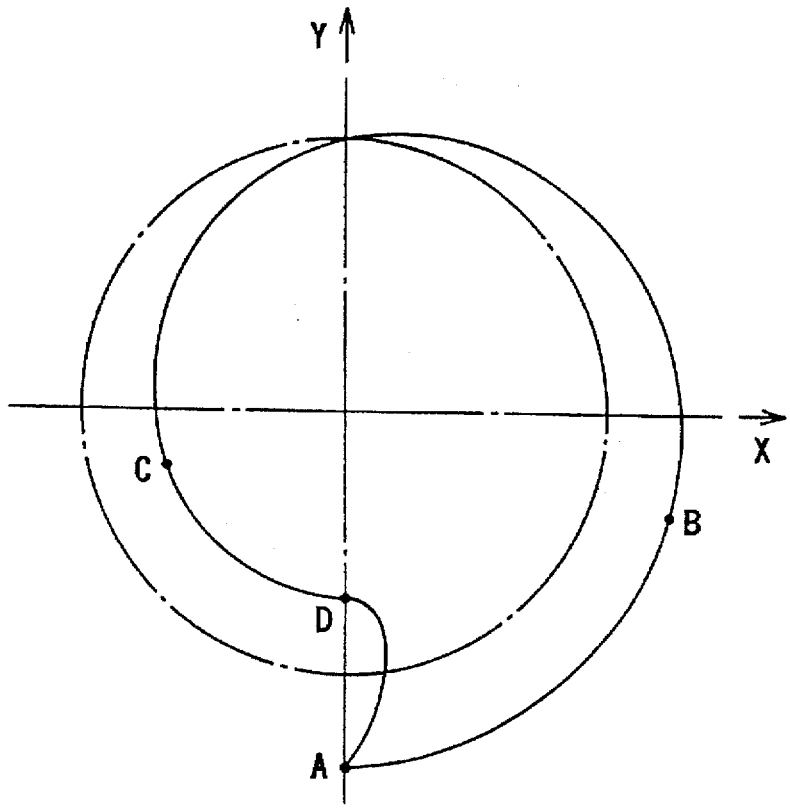
FIG. 12 is an enlarged fragmentary transverse cross-sectional view of a screw tooth of screw rotors according to another embodiment of the present invention.
Figure 13:
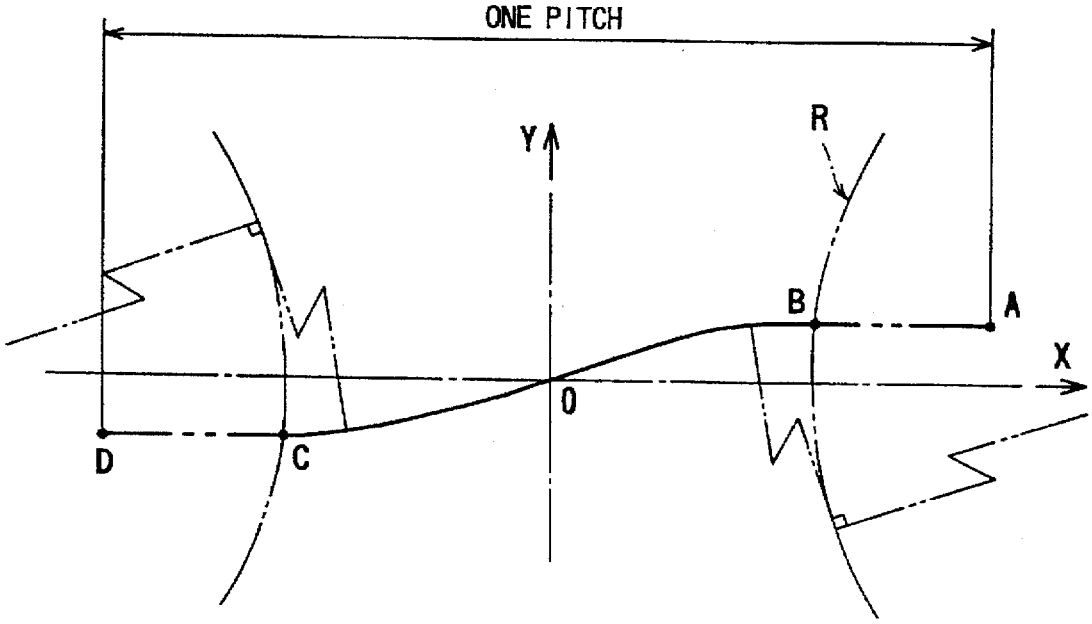
FIG. 13 is a diagram of an imaginary rack for generating the screw tooth shown in FIG. 12.

FIGS. 12 and 13 show a screw tooth of screw rotors according to another embodiment of the present invention. The screw tooth of each of the screw rotors has a transverse tooth profile which includes a curve BC (see FIG. 12) which is generated by an imaginary rack (see FIG. 13) that comprises a combination of two involute curves based on base circles R.

Figure 14:
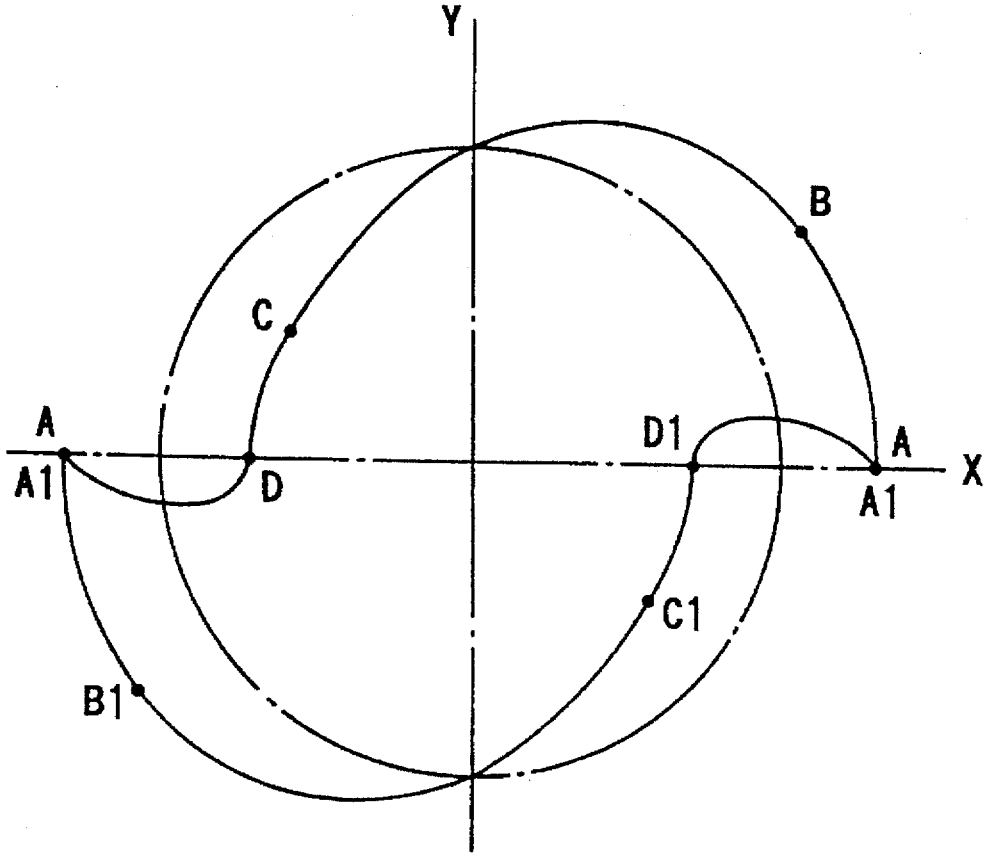
FIG. 14 is an enlarged fragmentary transverse cross-sectional view of a screw tooth of double-threaded screw rotors according to still another embodiment of the present invention.

FIG. 14 shows a screw tooth of double-threaded screw rotors according to still another embodiment of the present invention. As shown in FIG. 14, the screw tooth has a tooth profile including curves BC, B1C1 each generated by an imaginary rack defined by a sine curve.

The tooth profile shown in FIGS. 5 and 6 makes it possible to increase the depth of the grooves of the screw rotors for increasing the flow rate because no interference is caused between the screw rotors. However, the screw rotor which is single-threaded tends to be out of dynamic equilibrium upon rotation because the center of gravity of the tooth profile is not aligned with the center of the screw rotor, and hence are not suitable for high-speed rotation. According to the embodiment shown in FIG. 14, however, since the center of gravity of the tooth profile is aligned with the center of the double-threaded screw rotor, the screw rotor is kept in dynamic equilibrium upon rotation, and can be rotated at high speed.

Figure 15:
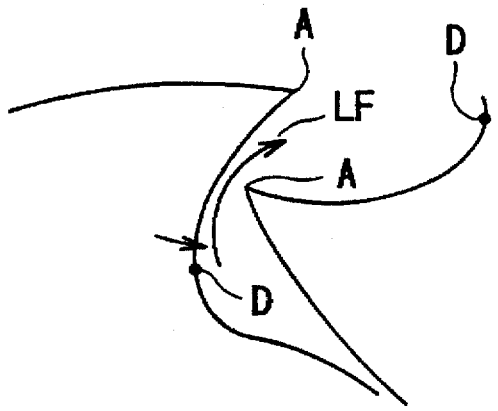
FIG. 15 is a fragmentary view illustrative of a fluid leakage in an intermeshing region of the screw rotors according to the embodiments shown in FIGS. 4 through 14.

FIG. 15 shows a fluid leakage LF in an intermeshing region between the screw rotors according to the embodiments shown in FIGS. 4 through 14. The tooth profile of each of the screw rotors includes a point A which provides a linear seal with respect to the curve DA of the other screw rotor. The fluid leakage LF is liable to occur through the linear seal provided by the point A.

Figure 16:
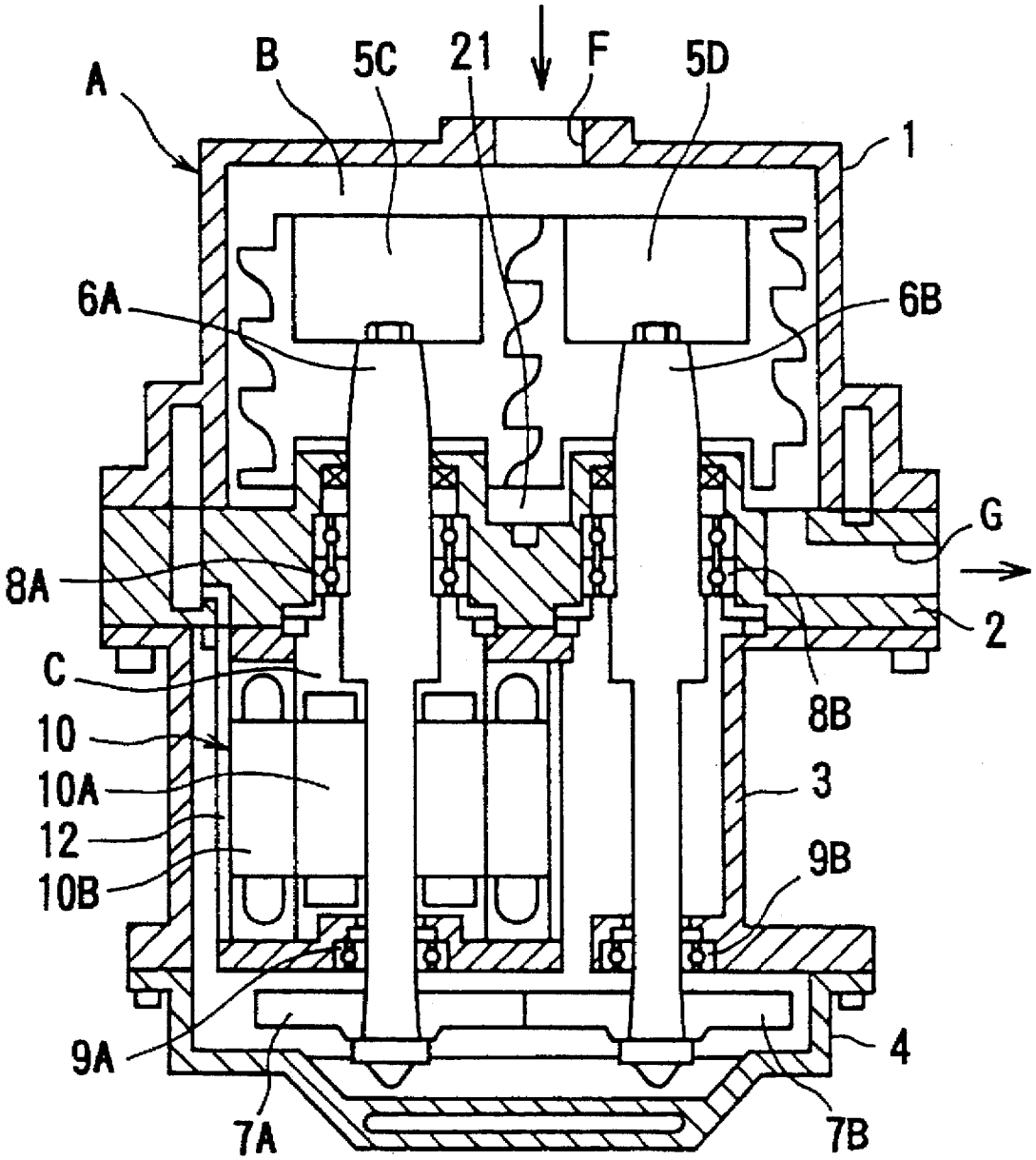
FIG. 16 is a cross-sectional view of a pair of screw rotors according to a further embodiment of the present invention, incorporated in a screw vacuum pump as a screw machine.

FIG. 16 shows a pair of screw rotors according to a further embodiment of the present invention, incorporated in a screw vacuum pump as a screw machine. The screw vacuum pump shown in FIG. 16 is identical to the screw vacuum pump shown in FIG. 1 except for the tooth profile of screw rotors 5C, 5D.

Figure 17:
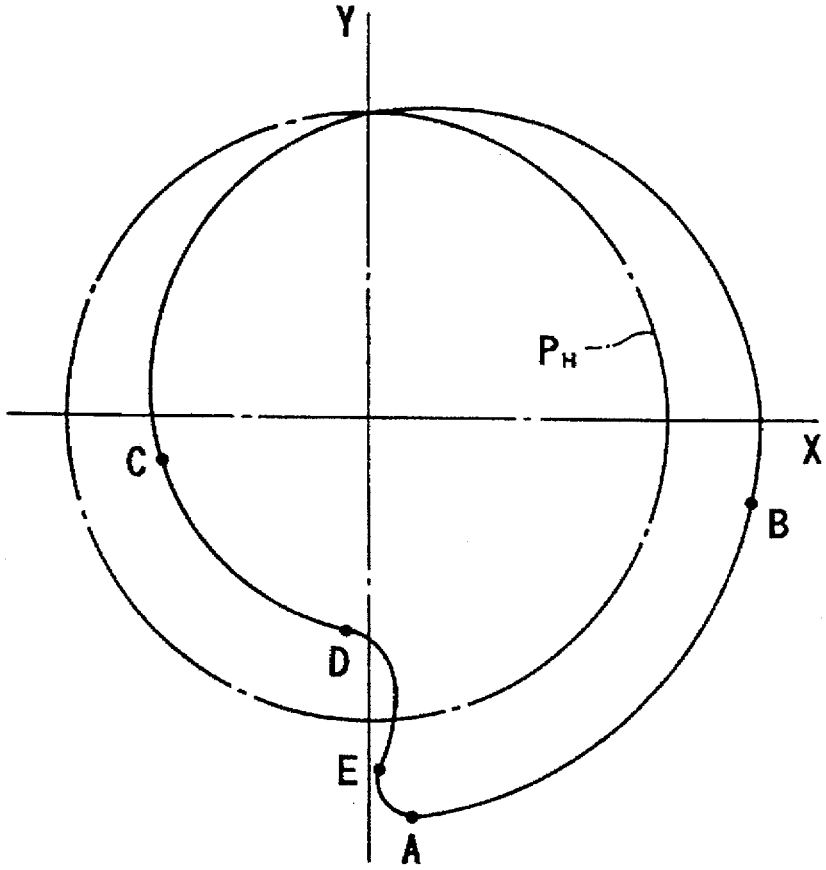
FIG. 17 is an enlarged fragmentary transverse cross-sectional view of a screw tooth of the screw rotors shown in FIG. 16.

The screw rotors 5C, 5D have respective screw teeth each having a transverse or normal-to-axis tooth profile as shown in FIG. 17. As shown in FIG. 17, the transverse tooth profile comprises an outer circumferential circular arc AB extending around the center of the screw rotor, a tooth root circular arc CD extending around the center of the screw rotor, a curve BC interconnecting the outer circumferential circular arc AB and the tooth root circular arc CD, and a curve DA interconnecting the outer circumferential circular arc AB and the tooth root circular arc CD in substantially diametrically opposite relation to the curve BC. The curve DA comprises two curve segments, i.e., an tooth tip arc EA connected to the outer circumferential circular arc AB and a curve DE connected to the tooth root circular arc CD.

The tooth tip arc EA is defined as an arc having a radius of curvature which is equal to or less than the difference between the radius of curvature of the outer circumferential circular arc AB and the radius R (see FIG. 7) of the pitch circle $P_H$. The curve DE comprises a curve connected to and between the tooth root circular arc CD and the tooth tip arc EA and generated by a tooth tip arc EA of the companion screw rotor.

Figure 18:
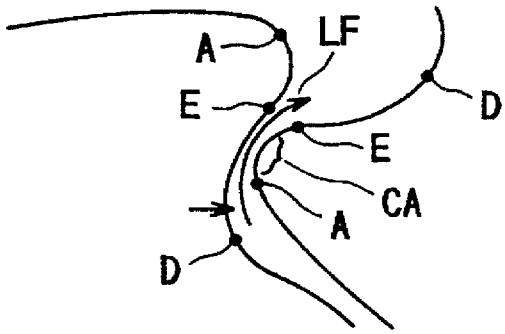
FIG. 18 is a fragmentary view illustrative of a fluid leakage in an intermeshing region of the screw rotors according to the embodiment shown in FIG. 16.
Figure 19:
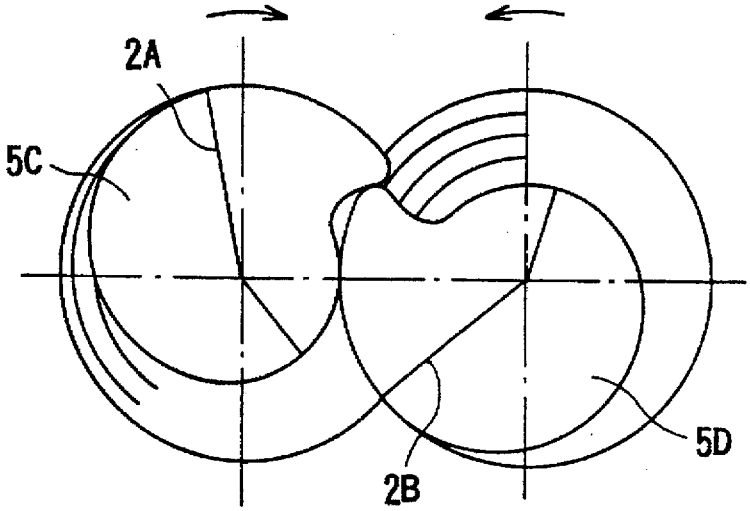
FIG. 19 is a view of a phase of intermeshing engagement between the screw rotors shown in FIG. 16.
Figure 20:
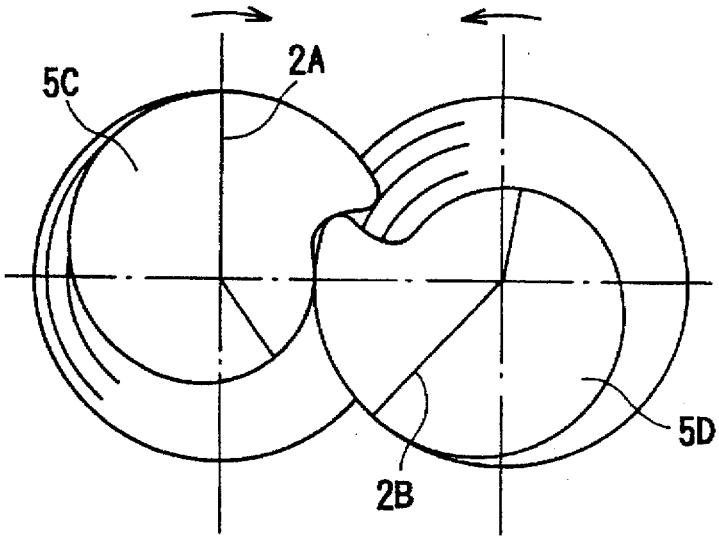
FIG. 20 is a view of another phase, next to the phase shown in FIG. 19, of intermeshing engagement between the screw rotors.
Figure 21:
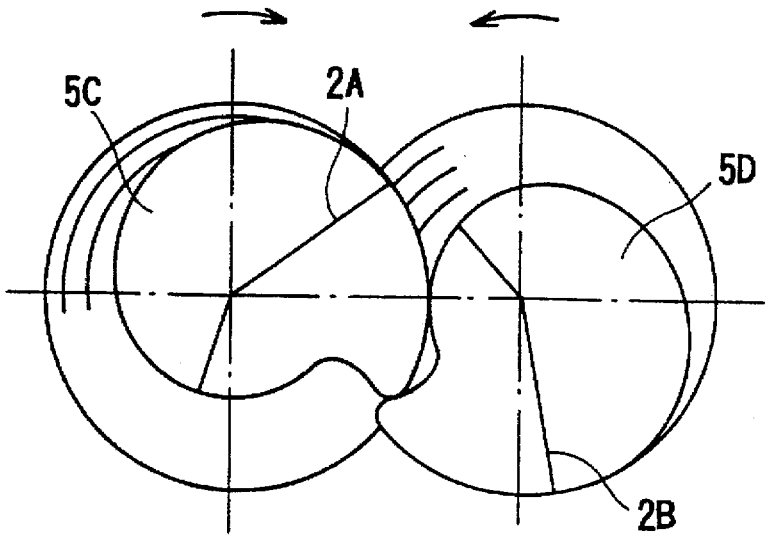
FIG. 21 is a view of still another phase, next to the phase shown in FIG. 20, of intermeshing engagement between the screw rotors.
Figure 22:
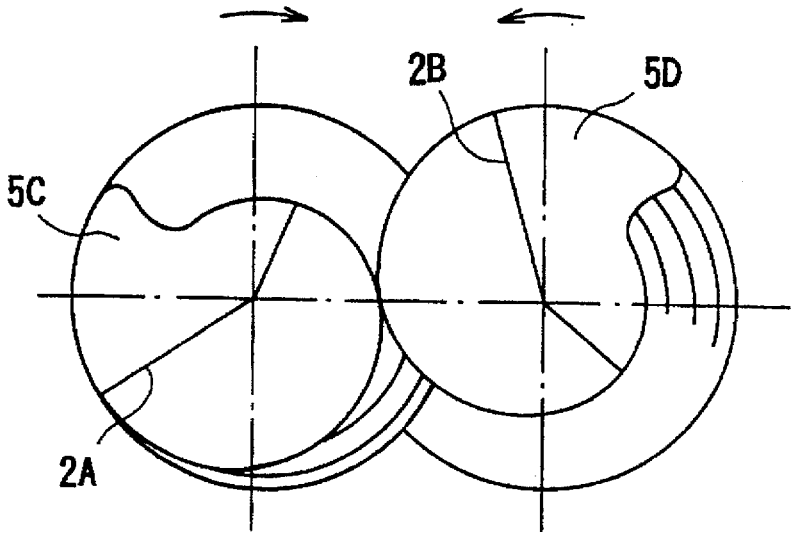
FIG. 22 is a view of yet still another phase, next to the phase shown in FIG. 21, of intermeshing engagement between the screw rotors.

FIG. 18 shows a fluid leakage LF in an intermeshing region between the screw rotors according to the embodiment shown in FIG. 17. As shown in FIG. 18, the tooth tip arc EA provides a surface seal CA with respect to the curve DE of the other screw rotor. The surface seal CA has a longer width or greater area for blocking the fluid leakage LF than the liner seal shown in FIG. 15, thereby reducing the fluid leakage LF in comparison with the liner seal shown in FIG. 15.

FIGS. 19 through 22 show successive phases of intermeshing engagement between the screw rotors 5C, 5D shown in FIG. 16, illustrating the manner in which the tooth profile of the screw rotors 5C, 5D prevents them from interfering with each other while they are rotating in mesh with each other. The phases shown in FIGS. 19 through 22 correspond respectively to the phases shown in FIGS. 6 through 9.

Figure 23:
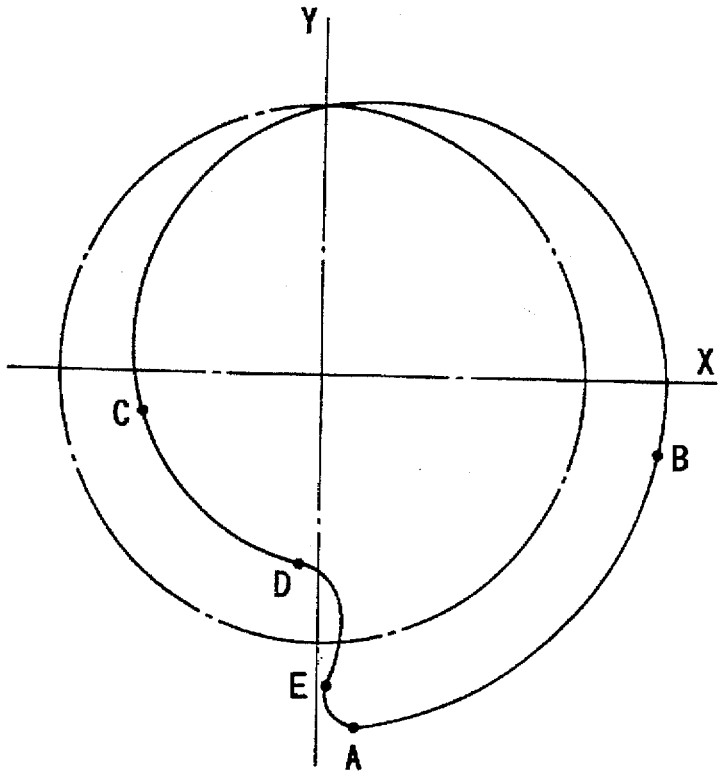
FIG. 23 is an enlarged fragmentary transverse cross-sectional view of a screw tooth of screw rotors according to a still further embodiment of the present invention.

FIG. 23 shows a screw tooth of screw rotors according to a still further embodiment of the present invention. The tooth profile of the screw tooth shown in FIG. 23 differs from the tooth profile of the screw tooth shown in FIG. 12 except that it additionally includes a tooth tip arc EA similar to the tooth tip arc EA shown in FIG. 17. The tooth tip arc EA shown in FIG. 23 is effective to reduce any fluid leakage along the screw rotors in comparison with the tooth profile shown in FIG. 12.

Figure 24:
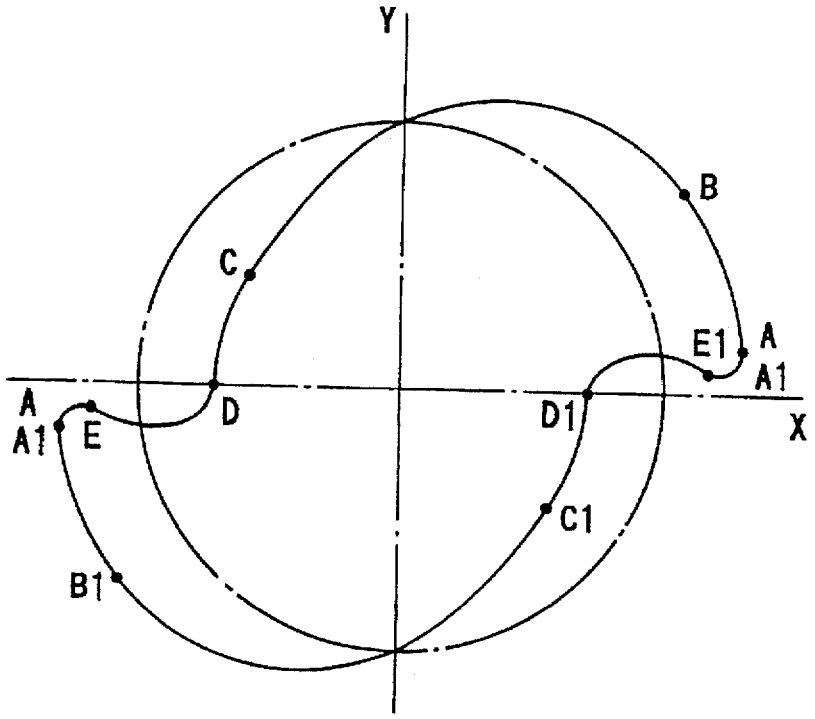
FIG. 24 is an enlarged fragmentary transverse cross-sectional view of a screw tooth of double-threaded screw rotors according to a yet still further embodiment of the present invention.

FIG. 24 shows a screw tooth of double-threaded screw rotors according to a yet still further embodiment of the present invention. The tooth profile of the screw tooth shown in FIG. 24 differs from the tooth profile of the double-threaded screw tooth shown in FIG. 14 except that it additionally includes tooth tip arcs EA, E1A1 each similar to the tooth tip arc EA shown in FIG. 17. The tooth tip arcs EA, E1A1 shown in FIG. 24 are effective to reduce any fluid leakage along the screw rotors in comparison with the tooth profile shown in FIG. 14.

In each of the above embodiments, the screw rotors have respective tooth profiles that are identical to each other. However, the principles of the present invention are applicable to a pair of screw rotors, i.e., male and female rotors, having different tooth profiles.

As is apparent from the above description, the present invention offers the following advantages:

(1) Since the tooth profiles of the screw rotors of the above configuration are theoretically kept out of interference with each other, it is not necessary to chamfer the tooth profiles of the screw rotors or unduly increase the gap between the tooth profiles of the screw rotors to avoid any interference therebetween.

(2) Since the screw rotors have a good sealing characteristics, a fluid leakage is reduced to a minimum degree.

(3) If the screw rotor has multiple thread, since the center of gravity of the tooth profile is aligned with the center of the threaded screw rotor, the screw rotor is kept in dynamic equilibrium upon rotation.

(4) Since an outer circumferential width can be freely determined, the width of the surface seal on the outer circumferential surface of the screw rotor may be optimized for a reduced fluid leakage, and hence the screw rotor can thus be designed for a more ideal configuration.

Although certain preferred embodiments of the present invention have been shown and described in detail, it should be understood that various changes and modifications may be made therein without departing from the scope of the appended claims.

What is claimed is:

1. A method of generating a transverse tooth profile of a screw rotor, comprising the steps of:

defining a transverse tooth profile of a screw rotor meshing with a companion screw rotor, with a tooth root circular arc, an outer circumferential circular arc, and two curves interconnecting the tooth root circular arc and the outer circumferential circular arc;

defining one of said two curves by a trochoid curve generated by a point on an outer circumferential surface of the companion screw rotor; and defining the other of said two curves by determining a curve which defines an imaginary rack and producing a tooth profile curve generated by the imaginary rack.

2. A method according to claim 1, wherein said curve which defines said imaginary rack comprises a sine curve.

3. A method according to claim 1, wherein said curve which defines said imaginary rack comprises a combination of two involute curves.

4. A screw rotor for meshing with a companion screw rotor, having a transverse tooth profile, said transverse tooth profile comprising:

a tooth root circular arc;

an outer circumferential circular arc; and two curves interconnecting said tooth root circular arc and said outer circumferential circular arc;

wherein one of said curves is defined by a trochoid curve generated by a point on an outer circumferential surface of the companion screw rotor, and the other of the curves is generated by an imaginary rack which is defined by a predetermined curve.

5. A screw rotor according to claim 4, wherein said predetermined curve which defines the imaginary rack comprises a sine curve.

6. A screw rotor according to claim 4, wherein said predetermined curve which defines the imaginary rack comprises a combination of two involute curves.

7. A screw rotor according to claim 4, wherein said screw rotor has multiple thread.

8. A screw machine having a pair of screw rotors held in mesh with each other and out of contact with each other and rotatable in synchronism with each other for drawing and discharging a fluid, each of said screw rotors having a transverse tooth profile, said transverse tooth profile comprising:

a tooth root circular arc;

an outer circumferential circular arc; and two curves interconnecting said tooth root circular arc and said outer circumferential circular arc;

wherein one of said curves is defined by a trochoid curve generated by a point on an outer circumferential surface of the companion screw rotor, and the other of the curves is generated by an imaginary rack which is defined by a predetermined curve.

9. A screw machine according to claim 8, wherein said predetermined curve which defines the imaginary rack comprises a sine curve.

10. A screw machine according to claim 8, wherein said predetermined curve which defines the imaginary rack comprises a combination of two involute curves.

11. A screw machine according to claim 8, wherein each of said screw rotors has multiple thread.

* * * * *